United States Patent [19]

Schillreff

[11] 4,178,854

[45] Dec. 18, 1979

[54] MULTIPLE SEQUENTIAL BURST SYSTEM

[75] Inventor: George H. Schillreff, Glendora, Calif.

[73] Assignee: General Dynamics Corporation, Pomona Division, Pomona, Calif.

[21] Appl. No.: 692,995

[22] Filed: Dec. 22, 1967

[51] Int. Cl.[2] ..... F42B 13/42

[52] U.S. Cl. ..... 102/89 CD; 102/34.4; 343/18 E

[58] Field of Search ..... 102/34.4, 49.4, 49.5, 102/37.6, 37.7, 89; 343/18 B, 18 E

[56] References Cited

U.S. PATENT DOCUMENTS

| | | | |
|---|---|---|---|
| 2,476,302 | 7/1949 | Jeppson | 102/37.7 X |
| 3,302,759 | 3/1967 | Serenson | 343/18 E |

*Primary Examiner*—Verlin R. Pendegrass

*Attorney, Agent, or Firm*—Lafayette E. Carnahan; Edward B. Johnson

[57] ABSTRACT

A system which disperses a payload in a sequential manner. The payload may consist of a number of discrete individual payload units which are composed of two or more sections. The illustrated and described embodiment of the system is utilized in a rocket for dispersing decoy material, such as aluminum chaff, in a sequential burst pattern so as to produce a more uniform, widespread distribution of the decoy material. This is accomplished by sequential bursts of each unit which throw outwardly the payload sections of each unit, whereafter each of the payload sections are exploded. This concept may readily be applied to mortor type decoy rounds, other types of decoy material, or to other types of applications, requiring a sequential dispersion of the payload thereof.

10 Claims, 5 Drawing Figures

10
11
12
14
15
16
17
18
20
21
23
24
25
26
27
28

10
11
12
13
22
23
24
25
27

A
A
10'
11'
14'
15'
19'
20'
23'
25'
29
34
35
36
38
40
41
42
43

Time Delay Cap Assembly
Isolation Disc Assembly 35
38 Fuse
Time Delay Assembly 42
Explosive
Chaff Load
Fuse 32
Explosive 30
Fuse 34
19'
23'
25'
29
30
31
32
33
34
36
37
38
39
40
41
43

19'
23'
24'
25'
30
32
33
34
40
41

MULTIPLE SEQUENTIAL BURST SYSTEM

BACKGROUND OF THE INVENTION

This invention relates to countermeasure systems, particularly to systems for providing a protective cover against homing and/or fire control devices operating upon infrared, sonar, or microwave reflected energy or for confusing search and tracking devices, and more particularly to a system for sequentially bursting the payload containing material capable of providing a more uniform, widespread protective cover.

RELATED APPLICATIONS

This invention is an improvement over that disclosed and claimed in copending U.S. patent application Ser. No. 680,712 entitled "Sequential Burst System" and assigned to the same assignee. While the above mentioned application is directed to a system for sequentially bursting various units of the payload, this invention is more particularly directed to a system for sequentially bursting into sections the various units of the payload, and then bursting the payload sections such that a more uniform, widespread distribution of a payload, such as aluminum chaff, can be achieved, thereby serving as a larger and more effective cover by confusing sensing mechanism sensitive to the type of payload being dispersed.

SUMMARY OF THE INVENTION

This invention relates to a multiple sequential burst system particularly adapted for dispersing decoy material carried in a round of the rocket or mortor type. The inventive system has particular application in dispersing decoy material, such as infrared, sonar, or microwave reflected energy, in a large desired pattern for more effectively confusing search and tracking devices and for providing a protective cover against homing and/or fire control devices sensitive to these types of energy. The system of the invention is adapted for utilization in rounds or the like which are utilized in launching mechanisms which can be located on land, sea, underwater, or air vehicles.

Therefore, it is an object of this invention to provide a multiple sequential burst system.

A further object of the invention is to provide a multiple sequential burst system for dispersing material in a desired uniform, widespread pattern.

Another object of the invention is to provide a multiple sequential burst system for the payload of a rocket-type or mortor-type decoy round.

Another object of the invention is to provide a system for dispersing in a uniform and widespread pattern, infrared sonar, or microwave reflecting material in a sequential manner.

Another object of the invention is to provide a rocket or mortor decoy round with a system for activating and sequentially bursting a plurality of discrete individual units, each containing of a plurality of sections of decoy material, thereby producing a more uniform and widespread pattern of material for more effectively confusing devices sensitive to energy of the type produced by the dispersed material.

Other objects of the invention, not specifically set forth above, will become readily apparent from the following description and accompanying drawings wherein:

DESCRIPTION OF THE EMBODIMENTS

Figure 1:
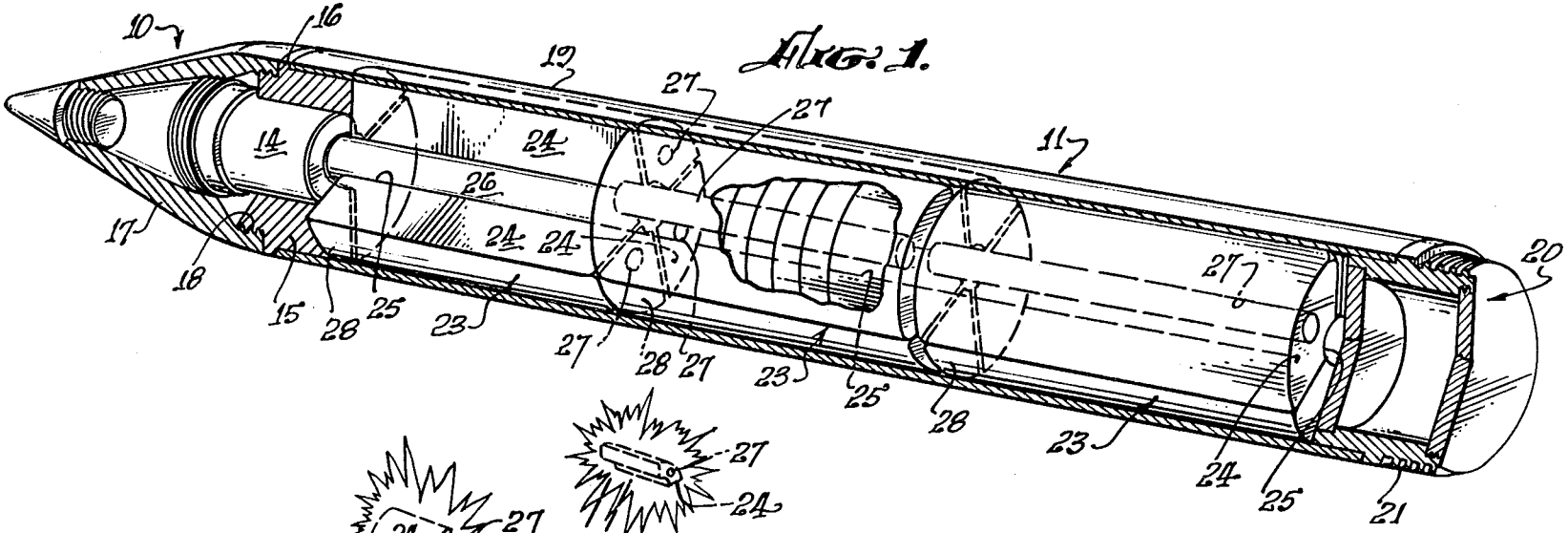
FIG. 1 is a view partially in cross-section of an embodiment of a portion of a rocket-type decoy round incorporating the inventive concept.
Figure 2:
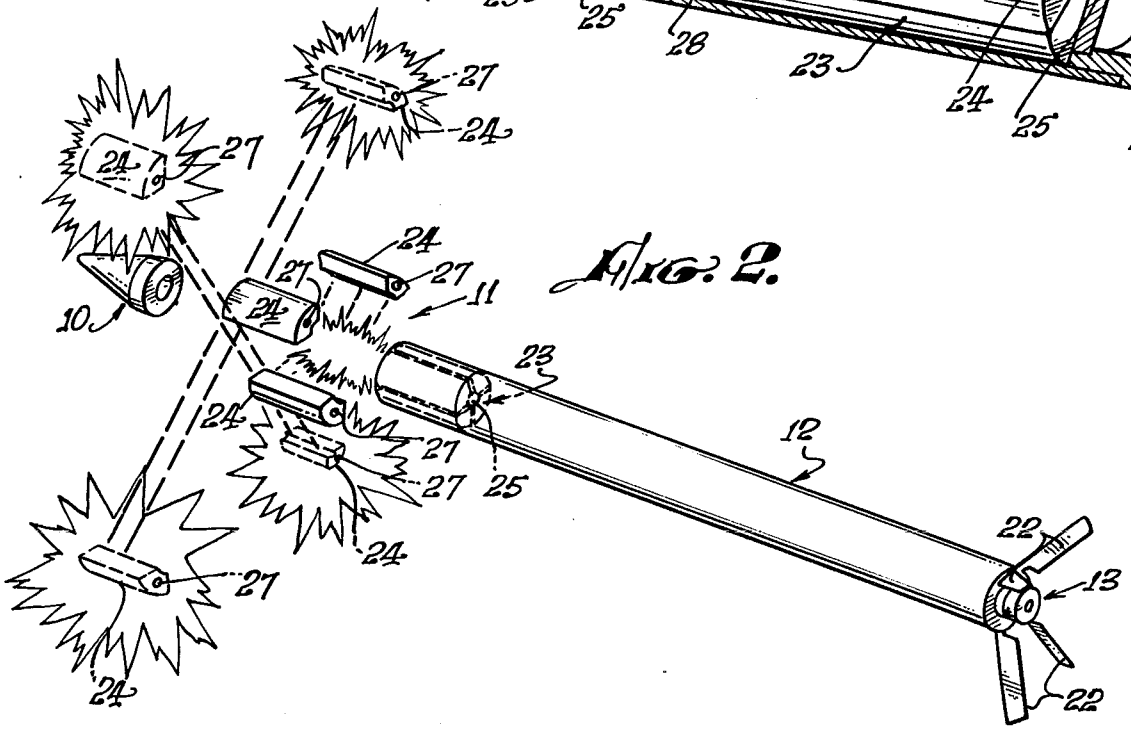
FIG. 2 is a view illustrating the inventive burst concept.

The embodiment of the rocket shown in FIGS. 1 and 2 comprises a head or nose cone section generally indicated at 10, a payload section generally indicated at 11, a motor or propulsion section generally indicated at 12, and a tail section generally indicated at 13.

The details of the nose cone or head section 10 does not constitute part of this invention and thus will not be described in detail, but may be of the type described in the above mentioned copending application. However, the nose cone section includes an acceleration delay timer generally indicated at 14 and which includes a battery, a safe and arm mechanism, and the required electrical connections and fuzing mechanism to activate the hereinafter described bursting apparatus of payload section 11.

The payload section 11 of the rocket, as shown in FIGS. 1 and 2, comprises a nose cone or head adapter member 15 (see FIG. 1) which includes a flange or raised portion 16 which serves as an abutment when a dome 17 of nose cone section 10 is threadedly secured at 18 to section 11. A skin or casing 19, constructed of suitable frangible material such as phenolic, is secured to the adapter 15 rearwardly of flange 16 by suitable bonding material. Note that the external surfaces of dome 17, flange 16, and casing 19 from a substantially continuous surface. Casing or skin 19 terminates at the rearward end in a motor adapter 20 to which the rocket motor section 12 is threadedly secured to threads 21 thereof. Secured to the motor section 12 by means not shown is the tail assembly section 13 which includes a plurality of tail fins 22 pivotally mounted to the housing thereof and which are stowed or launched in the retracted position and extend to the flight position shown upon launch of the rocket from a suitable launching mechanism, not shown. Since the motor adapter 20, the motor section 12 and the tail section 13 do not constitute a part of this invention a detailed description thereof is deemed unnecessary. However, these assemblies may be similar to those described in greater detail in the above referenced copending application.

Positioned within the skin or casing 19 of payload section 11 is a number of individual payload units generally indicated at 23 (three such units being shown in this embodiment) of suitable decoy material for confusing or attracting devices operating upon or sensitive to infrared, sonar, or microwave reflected energy. The specific illustrated payload material of units 23 in this embodiment is composed of suitably constructed aluminum chaff.

Each of the payload units 23, as shown, are substantially identical, but may be constructed so as to have various lengths such that the desired burst pattern of the decoy material may be accomplished. Units 23 each are composed of a plurality of individual sections 24 comprising a chaff load (four sections 24 being shown in the FIGS. 1 and 2 embodiment). Payload sections 24 of each unit 23 are configured to define a central opening 25 within which is positioned a dispersion assembly 26 and which includes a burst or dispersion explosive holder containing PETN or other suitable material. A blast plug (not shown) constructed of mild steel or other appropriate material is positioned in the rearward portion of each of the central openings 25 of payload units 23. Each of the payload sections 24 are provided with apertures or openings 27 within which is positioned a dispersion assembly, described hereinafter with respect to the FIGS. 3–5 embodiment. Also, the payload section 11 is provided with suitable fuzing means, not shown, but similar to those described hereinafter with respect to FIG. 3. The general construction of chaff load is not part of this invention and the details thereof will not be described, but may, for example, be similar to that illustrated and described in the above mentioned copending application.

Positioned at the forward end of each of payload units 23 is an isolation disc assembly 28 which may be, for example, constructed of mild steel, disc assemblies 28 being described in greater detail hereinafter.

Figure 3:
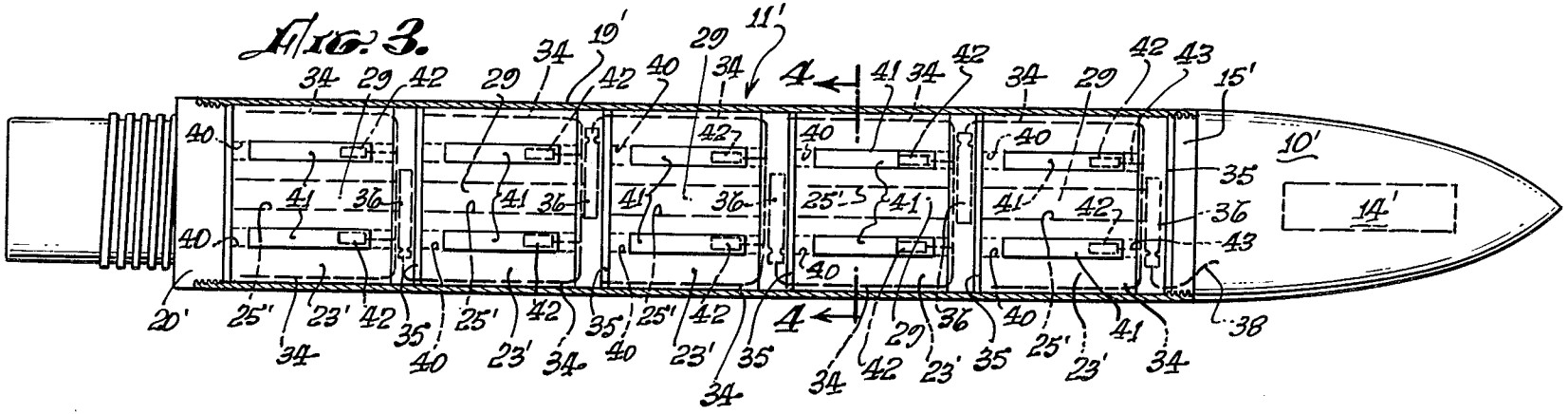
FIG. 3 is a diagrammatic view of another payload embodiment of the rocket-type round incorporating the invention.
Figure 5:
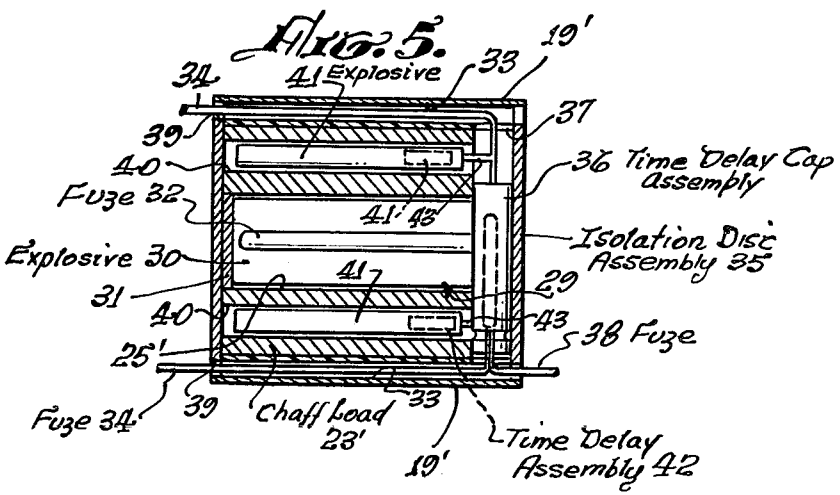
FIG. 5 is an enlarged, partial cross-sectional view of one unit of the FIG. 3 round.
Figure 4:
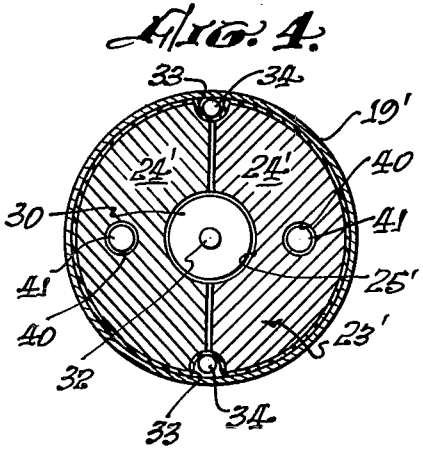
FIG. 4 is a cross-sectional view taken along the lines 4—4 of FIG. 3.

While the multiple sequential bursting of the payload section 11 will become more readily apparent in view of the description of the FIGS. 3–5 embodiment, the general operation is illustrated in FIG. 2. wherein the four sections 24 of each of the payload units 23 are first blown outwardly by the dispersing mechanism 26 whereafter each of the individual sections 24 are dispersed by mechanism located in openings 27, such that a uniform, widespread distribution of the decoy material is obtained, thereby providing a more effective cover.

The FIGS. 3–5 embodiment diagrammatically illustrate the dispersion mechanism for accomplishing the inventive concept. As shown in FIG. 3, the round comprises a nose cone or head section 10' and a payload section 11'. Nose cone section 10' is provided with an acceleration delay timer assembly 14' similar to that described above with respect to FIG. 1 and is operatively connected with the payload section 11' via an adapter 15' as previously described. The aft end of the payload section 11' is provided with an adapter 20' for securing a motor or propulsion means thereto. As in the FIG. 1 embodiment, the skin or casing 19' is constructed of suitable frangible material such as phenolic and is secured to the adapter 15' so as to provide a substantially smooth surface from the nose cone rearward. Positioned within the skin 19' is a number of individual payload units of suitable decoy material generally indicated at 23', and each composed of two separate sections 24' (see FIG. 4), there being five units 23' shown in this embodiment. Again, the specific illustrated material is composed of suitably constructed aluminum chaff but may be composed of other types of decoy material.

Each of the payload units 23', as shown, are substantially identical, but may be constructed so as to have various lengths such that the desired burst pattern of the decoy material may be accomplished. The sections 24' of each of the payload units are constructed so as to define a central opening 25' therein within which is positioned a dispersion assembly generally indicated at 29 which includes (see FIG. 5) a burst or dispersion explosive 30 of PETN or other suitable material, a blast plug 31 constructed of mild steel or other appropriate material, and a strip of primacord 32 or other suitable fuzing means. The chaff load 23' may be constructed as described above with respect to the load of the FIG. 1 embodiment. As seen in FIGS. 4 and 5, the payload sections 24' are constructed so as to define a pair of V or U cross-sectional configured passageways 33 through which primacord strips 34 or other suitable fuzing means extends from one unit 23' to the next, as seen in FIG. 3. The primacord strips 34 additionally function when activated to split the casing 19' as will be described hereinafter.

Positioned at the forward end of each of the payload units 23' is an isolation disc assembly 35 which may be, for example, constructed of mild steel. Mounted intermediate the disc assembly 35 and the payload unit 23' is a time delay cap assembly 36. The disc assembly 35 includes a flanged portion 37 which functions as a casing for the time delay cap assembly 36 and is provided with apertures through which the primacord 34 extends from the time delay cap assembly 36 to the passageways 33 defined by sections 24' as shown in FIG. 5. Interconnecting the acceleration delay timer assembly 14' (see FIG. 3) and the forward time delay cap assembly 36 is a length of primacord 38 or other suitable fuze means (see FIG. 5) which functions, as described hereinafter, to activate the inventive burst system. The disc assemblies 35 are provided with apertures 39 through which the primacord 34 and 38 extend for interconnection with the various time delay cap assemblies 36.

Each of the payload sections 24' are provided with a passageway 40 within which is mounted an explosive charge 41 which may, for example, be PETN for dispersing the chaff of the sections 24' upon activation by a time delay cap assembly 42 which is operatively connected with an associated time delay cap assembly 36 via primacord 43 or other fuzing means.

The arrangement of the fuzing mechanism is schematically shown in FIG. 3 wherein the time delay cap assemblies 36 are positioned 180° with respect to one another. However, other arrangements such as 90° or other offset positioning between units may be effectively utilized. The offset positioning of the interconnecting primacord 34 would serve to burst or split the frangible skin 19' at different locations when the primacord is ignited; as well as providing an effective method for developing a desired pattern of the decoy material when the units 23' are dispersed by the explosives 30 and 41.

While not shown in the FIG. 1 embodiment, the payload sections 24 would be configured to provide passageways similar to passageways 33 of FIG. 4 at the external adjoining edges for the positioning of primacord for splitting the casing or skin 19 in four locations so that the outward movement of the individual sections 24 as shown in FIG. 2 will not be retarded. The FIG. 1 embodiment, while not shown, includes time delay cap assemblies similar to assemblies 36 and 42, explosive charges similar to charges 30 and 41, and the required interconnecting fuzing of the FIGS. 3–5 embodiment such that the four payload sections 24 may be properly dispersed.

In operation the rocket is launched and the acceleration delay timer 14 or 14' is activated, as known in the art. The multiple sequential burst system is initiated by a blasting cap or equivalent initiating device (not shown) which has been activated by the timer assembly located in nose cone 10 or 10' via appropriate connections as known in the art. This initiation causes an explosive front to progress down the fuze or primacord 38 (which may, for example, be of the 6 grain/ft. type) to the first delay cap assembly 36 whereupon it is delayed an amount of time dependent upon the internal construction of assembly 36. Delay cap assemblies 36 and 42 may be manufactured for various delays ranging from 1 millisecond to 1 second. At the end of the delay period, the first cap assembly 36 explodes causing the following to occur:

1. The primacord 34 is activated in the forward payload unit 23 and splits the frangible skin 19 or 19' along the passageways 33 while cutting off the skin or casing at the approximate location of the isolation disc assembly 35 located at both the forward and rearward ends of the forward payload unit 23, thereby breaking the nose cone section 10 or 10' away from the remainder of the rocket, as shown in FIG. 2.

2. At substantially the same time the dispersing explosive 30 (PETN, for example) of the forward unit 23 is activated by primacord of fuze 32 which blows the individual payload sections 24 or 24' outwardly while activating the time delay assembly 42 in each of the payload sections via primacord or fuze 43.

3. Primacord strips 34, in addition to splitting the skin 19 or 19' of the forward unit 23 activates the time delay cap assembly 36 of the next payload unit 23. The next unit 23 is protected from damage by the explosion in the first unit due to the first blast plug 31 and the second isolation disc assembly 35.

4. After a predetermined time delay, dependent upon the construction of the delay assemblies 42, the explosive charges 41 are activated thereby dispersing the tightly packaged chaff of the payload sections 24 or 24'.

5. The sequence is repeated for each of the payload units 23 or 23'; thereby producing a more uniform, widespread distribution of the chaff.

By way of example, the payload sections 24 or 24' are blown outwardly about 50 feet from the center before they detonate, thereby producing a pattern which is about 250 feet in diameter, while the sequential bursting of the individual units provide an overall length of about 800 feet, thereby providing a large cover or cloud of decoy material for confusing or attracking devices operating upon or sensitive to the type of decoy material dispersed.

The payload units 23 can be made in various lengths (giving consideration to aerodynamic stability of the rocket or mortor) as might be required by a tactical situation. Furthermore, there can be more or less than the three or five units shown with a various number of sections in the different units. There can also be utilized different sized units, or units that contain different payloads. Also, the type of round may be of the mortor launched type. In addition, appropriate electrical type fuzing may be utilized between the time assembly and the first or foreward time delay cap assembly.

It has thus been shown that this invention provides a multiple sequential burst system which can effectively disperse payload units of desired size in a desired pattern, and which is particularly adapted to, but not limited to, an effective system for dispersing decoy material for confusing or attracting devices sensitive to or operating upon infrared, sonar, or microwave reflected energy.

In addition to the use of the inventive concept for producing a large cloud or coverage, the time delay mechanisms may be so designed that a phase front or moving target is depicted by the decoy material. Also, by changing the time delays a number of individual targets or clouds may be produced by a single round.

While particular embodiments of the invention have been illustrated and described, modifications and changes will become apparent to those skilled in the art, and it is intended to cover in the appended claims all such modifications and changes as come within the spirit and scope of this invention.

What I claim is:

1. In a decoy round containing at least a nose cone section, a payload section having at least two payload units, and a propulsion section; a multiple sequential burst system comprising a timing mechanism, a time delay assembly means positioned in each of said payload units, each of said payload units consisting of at least two sections, means within each of said payload units for separating said unit sections, fuzing means operatively connecting a first of said time delay assembly means with said timing mechanism for activating said time delay assembly means, fuze means interconnecting said time delay assembly means and extending adjacent an external surface of said payload unit section for splitting the skin of said payload section upon activation of said fuze means and for activating the next of said time delay assembly means, means operatively connecting said time delay assembly means with said payload unit separating means for activating same, time delay means within each of said payload unit sections for activating dispersing means for said unit sections, means for connecting said time delay assembly means with each of said unit section time delay means of the associated payload unit for activating said time delay means, whereby after a predetermined condition of flight of said round the timing mechanism initiates said multiple sequential burst system by activating said first of said time delay assembly means which in turn activates a first of said payload unit separating means and said interconnecting fuze means of said first payload unit and activates the time delay means of each of said unit sections of that payload unit thereby splitting the skin of said payload unit and activating the next time delay assembly means while substantially simultaneously blowing the sections of that payload unit apart and whereafter said time delay means of said unit sections disperses said section and said next time delay assembly means causes the next payload unit to be blown apart and dispersed and so on throughout the payload section.

2. The multiple sequential burst system defined in claim 1, wherein said timing mechanism is operatively mounted in said nose cone section of said decoy round.

3. The multiple sequential burst system defined in claim 1, wherein said payload unit sections are configured to provide a central opening in said payload unit and passageways along the external surface of the unit.

4. The multiple sequential burst system defined in claim 3, wherein said payload units are separated by isolation assembly means, said payload units separating means being located longitudinally along said central opening of said payload units, said payload unit section dispersing means being located longitudinally in a passageway in each of said payload unit sections, and said interconnecting fuze means being located in said passageways along the external surface of said payload units.

5. The multiple sequential burst system defined in claim 4, wherein said time delay assembly means are operative positioned intermediate said isolation assembly means and the forward end of the associated payload unit.

6. The multiple sequential burst system defined in claim 1, wherein said payload units contain decoy material for devices operating upon infrared, sonar, and microwave reflected energy when utilized both singly and in any combination thereof.

7. The multiple sequential burst system defined in claim 1, wherein said round additionally includes a tail section operatively attached to said propulsion section, thereby defining a rocket type round.

8. The multiple sequential burst system defined in claim 1, wherein said payload units are positioned within a frangible outer skin of said payload section and separated from one another by isolation assemblies within which said time delay assembly means for the associated payload unit is operatively positioned; each of said payload unit sections being composed of a body of decoy material capable of generating energy selected from the group consisting of infrared, sonar, and microwave reflected energy; said payload unit sections being configured to define a central longitudinally extending opening and a recessed area along the external adjacent surfaces thereof; each of said payload unit sections being provided with a passageway extending longitudinally therethrough; each of said payload units having said separating means operatively positioned within said central opening thereof and said interconnecting fuze means extending along said recessed area of said unit sections; said payload unit section dispersing means being operatively positioned within said longitudinal passageway of said unit sections; said time delay assembly means for each payload unit being operatively connected with said payload unit section separating means, said interconnecting fuze means, and said payload unit section dispersing means thereof.

9. The multiple sequential burst system defined in claim 8, wherein said payload unit section separating means comprises a predetermined type of explosive, a blasting plug of suitable material positioned intermediate said explosive and the isolation assembly means adjacent the next payload unit, and a fuze member operatively connected to said time delay assembly means.

10. The multiple sequential burst system defined in claim 9, wherein said fuzing means, said fuze means, and said fuze member are constructed of primacord.

* * * * *